US006975186B2

(12) United States Patent
Hirabayashi

(10) Patent No.: US 6,975,186 B2
(45) Date of Patent: Dec. 13, 2005

(54) FILTER CIRCUIT

(75) Inventor: Takayuki Hirabayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 41 days.

(21) Appl. No.: 10/496,815

(22) PCT Filed: Dec. 4, 2002

(86) PCT No.: PCT/JP02/12722

§ 371 (c)(1),
(2), (4) Date: May 27, 2004

(87) PCT Pub. No.: WO03/050908

PCT Pub. Date: Jun. 19, 2003

(65) Prior Publication Data

US 2005/0017824 A1 Jan. 27, 2005

(30) Foreign Application Priority Data

Dec. 12, 2001 (JP) ..... 2001-379080

(51) Int. Cl.[7] ..... H01P 1/20
(52) U.S. Cl. ..... 333/204; 333/202; 333/185; 333/219
(58) Field of Search ..... 333/204, 202, 333/185, 219

(56) References Cited

U.S. PATENT DOCUMENTS 3,621,367 A * 11/1971 Rosen et al. ..... 333/218
3,745,489 A * 7/1973 Cristal et al. ..... 333/185
3,982,214 A * 9/1976 Burns ..... 333/164
4,157,517 A * 6/1979 Kneisel et al. ..... 333/205
5,066,933 A * 11/1991 Komeda ..... 333/204
5,608,364 A * 3/1997 Hirai et al. ..... 333/204
5,880,652 A * 3/1999 Snel ..... 335/204
5,963,115 A * 10/1999 Holleboom et al. ..... 333/204
6,130,189 A * 10/2000 Matthaei ..... 505/210
6,483,404 B1 * 11/2002 Ammar et al. ..... 333/204
6,597,265 B2 * 7/2003 Liang et al. ..... 333/204
6,603,372 B1 * 8/2003 Ishizaki et al. ..... 333/204
6,784,766 B2 * 8/2004 Allison et al. ..... 333/205

FOREIGN PATENT DOCUMENTS

JP 63-182901 A 7/1988
JP 7-221580 A 8/1995
JP 8-330805 A 12/1996
JP 11-284471 A 10/1999

* cited by examiner

*Primary Examiner*—Robert Pascal
*Assistant Examiner*—Kimberly Glenn
(74) *Attorney, Agent, or Firm*—Robert J. Depke; Trexler, Bushnell, Giangiorgi, Blackstone & Marr, Ltd.

(57) ABSTRACT

This invention is a filter circuit provided in a radio communication module. First to third conductor patterns (8 to 10) having a length shorter than λ/4 of a passing wavelength λ and electromagnetically coupled with each other are formed as distributed line patterns parallel to each other in a dielectric board (2), and a first capacitor (16) and a second capacitor (17) add parallel capacitance to the first conductor pattern (8) and the second conductor pattern (9) having their distal ends short-circuited. The third conductor pattern (10) has its both end opened. As the first conductor pattern (8) and the second conductor pattern (9) carry out inductive operation and the third conductor pattern (10) is capacitive-coupled with these conductor patterns, resonance is made in a band lower than a frequency band prescribed by the length of the lines.

7 Claims, 9 Drawing Sheets

FILTER CIRCUIT

TECHNICAL FIELD

This invention relates to a filter circuit carried on a radio communication module or the like used in a microwave or millimeter wave band, and particularly to a filter circuit formed on a dielectric board to shorten a conductor pattern forming a resonator pattern.

This application claims priority of Japanese Patent Application No.2001-379080, filed on Dec. 12, 2001 in Japan, the entirety of which is incorporated by reference herein.

BACKGROUND ART

With the progress of telecommunication technology, radio communication modules are carried on various devices and systems such as various mobile communication devices, ISDN (integrated service digital network) and computer devices, and enable high-speed communication of data information and the like. The radio communication modules are reduced in size and weight, combined, or made multi-functional. In high-frequency applications using microwaves and millimeter waves as carrier frequencies, for example, in a communication device constituting a radio LAN (local area network) or the like, the radio communication modules cannot achieve the above-described specification requirements in a circuit based on a concentrated constant design in which a low-pass filter, a high-pass filter, a band-pass filter, a coupler and the like use chip components such as capacitors and coils, and a distributed constant design using microstrip lines, strip lines and the like is generally is used.

Conventionally, a band-pass filter (BPF) 100 based on a distributed constant design is formed by cascading plural resonator conductor patterns 102*a* to 102*e* on a major surface of a dielectric board 101, for example, as shown in FIG. 1. In the BPF 100, a high-frequency signal is inputted from the first outer conductor pattern 102*a*, and a high-frequency signal of a predetermined frequency band is selected by the second to fourth conductor patterns 102*b* to 102*d* arranged on the inner side and outputted from the fifth outer conductor pattern 102*e*. Except for the conductor pattern 102*c* at the central part, the conductor patterns 102 are coupled on the lateral side of the board 101. Although not shown, a ground pattern is formed on the entire rear side of the board 101.

In the BPF 100, the conductor patterns 102*a* to 102*e* adjacent to each other cascaded on the major surface of the dielectric board 101 as described above in such a manner that they overlap each other within a range of length of ¼ of the passing wavelength λ, as shown in FIG. 1. Since the conductor patterns 102 are formed on the board 101 having a high dielectric constant, the length of each conductor pattern 102 can be reduced by the wavelength shortening effect of the microstrip line and the BPF 100 can be miniaturized.

The shortening of wavelength occurs at $\lambda_0/\sqrt{\in w}$ (where $\lambda_0$ represents the wavelength in vacuum, and $\in w$ represents the effective relative dielectric constant, which is determined by electromagnetic field distribution of air and dielectric material) on the outer layer of the board 101, and also occurs at $\lambda_0/\sqrt{\in r}$ (where $\in r$ represents the relative dielectric constant of the board). Therefore, the BPF 100 selectively transmits a high-frequency signal of a desired frequency band by optimizing the conductor patterns 102*a* to 102*e*. In the BPF 100, since the conductor patterns 102 can be formed by on the major surface of the board 101 by performing printing or lithography processing as in a general wiring board forming process, these can be formed simultaneously with circuit patterns.

Even in such a BPF 100, the length of each of the conductor patterns 102*a* to 102*e* is regulated by the passing wavelength λ because the conductor patterns 102*a* to 102*e* overlap each other with an overlapping length substantially equal to λ/4 of the passing wavelength as they are arrayed. Therefore, the board 101 of a certain size is necessary to cover the lengths of the conductor patterns 102*a* to 102*e*, and the miniaturization of the BPF 100 is limited.

Meanwhile, another conventional BPF 110 shown in FIGS. 2A to 2C and FIG. 3 is formed by a so-called triplate structure in which resonator conductor patterns 113, 114 are formed within a multilayer board including a pair of dielectric boards 111, 112. Ground patterns 115, 116 are formed on the surfaces of the dielectric boards 111, 112, respectively, as shown in FIGS. 2A and 2C. Multiple via-holes 117 are formed in outer circumferential parts of the dielectric boards 111, 112 and continuity between the ground patterns 115, 116 on both sides is made, thus shielding the inner layer circuit.

Each of the resonator conductor patterns 113, 114 has a length M, which is substantially ¼ of the passing wavelength λ, and the resonator conductor patterns 113, 114 are formed in parallel with their one ends connected to the ground patterns 115, 116 and their other ends opened, as shown in FIG. 2B. On the resonator conductor patterns 113, 114, input/output patterns 118, 119 protruding in an arm-like shape toward the lateral side are formed. In the BPF 110, the resonator conductor patterns 113, 114 formed in the above-described dielectric boards 111, 112 are constructed to have parallel resonance circuits that are capacitive-coupled like equivalent circuits as shown in FIG. 3. Specifically, in the BPF 110, a parallel resonance circuit PR1 formed by a capacitor C1 and an inductor L1 connected between the resonator conductor pattern 113 and the ground pattern, and a parallel resonance circuit PR2 formed by a capacitor C2 and an inductor L2 connected between the resonator conductor pattern 114 and the ground pattern, are capacitive-coupled via a capacitor C3.

Such a BPF 110 has a function of resonating an open line of substantially λ/2 with respect to a high-frequency signal having a wavelength λ, in a predetermined frequency band, and utilizes the face that the degree of coupling reaches the maximum at λ/4. With this BPF 110, a high-frequency signal having a wavelength λ inputted from the resonator conductor pattern 113 is caused to resonate in the bans of the predetermined passing wavelength λ by the parallel resonance circuit PR1 and the parallel resonance circuit PR2. High-frequency components out of the band are removed and the signal is then outputted. The BPF 110 is miniaturized as the lengths of the resonator conductor patterns 113, 114 formed in the dielectric boards 111, 112 are substantially λ/4.

Meanwhile, as the size and weight of mobile communication devices are further reduced, a radio communication module having an overall size of, for example, 10×10 mm or less, is demanded. Particularly in the case of carrying a radio communication module on a consumer mobile communication device or the like that has extremely tight cost requirements, the radio communication module must be equivalent to an inexpensive printed board that is generally used as board material.

The BPF 110 cannot meet the above-described specification requirements though the overall length of the resonator conductor patterns 113, 114 is reduced to $\lambda/4$. That is, in a radio LAN system or a short-distance radio transmission system called Bluetooth, the carrier frequency band is regulated to 2.4 GHz and the carrier wavelength $\lambda_0/4$ in the space is approximately 30 mm. Even if the resonator conductor patterns 113, 114 are built in a copper-clad multilayer board of FR grade 4 having a relative dielectric constant of approximately 4, which is carried on a radio communication module of a mobile communication device conformable to such a system and is generally used as a board material, for example, a copper-clad multilayer board made of burning-resistant glass cloth base epoxy resin, the passing wavelength $\lambda/4$ is approximately 15 mm. Therefore, the BPF 110 cannot meet the above-described specification requirements.

It may be considered that, for example, a ceramic material having a relative dielectric constant of 10 or more is used to improve the wavelength shortening effect and thus to miniaturize the BPF 110. Such a BPF 110 needs a large board when integrating peripheral components for a radio communication module, and the cost is increased by the use of the ceramic board, which is relatively expensive. Therefore, the above-described cost requirement cannot be met.

In the above-described BPF 110, the filter characteristics such as passing band characteristic and cutoff characteristic are determined by electromagnetic field distribution between the dielectric boards 111, 112 and between the resonator conductor patterns 113, 114. In the BPF 110, the strength of the electric field changes in accordance with the facing spacing p between the resonator conductor patterns 113, 114 in an odd excitation mode and also changes in accordance with the spacing between the dielectric boards 111, 112 and the resonator conductor patterns 113, 114 in an even excitation mode, that is, the thickness t of the dielectric boards 111, 112 shown in FIG. 2A. In the BPF 110, the strength of the electric field also changed in accordance with the width w of the resonator conductor patterns 113, 114 as shown in FIG. 2A.

In the BPF 110, since the strength of the electric field changes in accordance with the odd excitation mode or even excitation mode, the degree of coupling of the resonator conductor patterns 113, 114 changes and the filter characteristics change. In the BPF 110, the dielectric boards 111, 112 and the resonator conductor patterns 113, 114 are precisely formed in order to realize desired filter characteristics.

Generally, in the BPFs, desired filter characteristics cannot be achieved because of some difference in the manufacturing process, and an adjustment process is performed, for example, based on additional processing for properly changing the position and area of the resonator conductor patterns while checking their output characteristics by a measuring device or the like. In the BPF 110, since the resonator conductor patterns 113, 114 are formed in the inner layer of the dielectric boards 111, 112 as described above, it is difficult to perform such an adjustment process. Therefore, as a highly accurate manufacturing process to produce each part is employed for the BPF 110, the manufacturing efficiency is lowered and also the yield is lowered.

DISCLOSURE OF THE INVENTION

It is an object of this invention to provide a new filter circuit that can solve the problems of the conventional filter circuits as described above.

It is another object of this invention to provide a filter circuit that is miniaturized by acquiring predetermined filter characteristics while further reducing the length of each conductor pattern formed on a dielectric board to form a resonator pattern, to less than $\lambda/4$ with respect to a passing wavelength $\lambda$.

A filter circuit according to this invention includes a dielectric board, first to third conductor patterns formed with a length shorter than $\lambda/4$ of a passing wavelength $\lambda$ as distributed line patterns parallel to each other in the dielectric board, and a first capacitor and a second capacitor. The first conductor pattern has its one end grounded and has its other end opened, and a high-frequency signal is inputted to the first conductor pattern. The second conductor pattern has its one end grounded and has its other end opened, and it outputs a high-frequency signal of a predetermined frequency band selected from inputted high-frequency signals. The third conductor pattern has its both ends opened. The first capacitor and the second capacitor add parallel capacitance based on a concentrated constant to the first conductor pattern and the second conductor pattern.

The filter circuit according to this invention has a third capacitor for adding serial capacitance based on a lumped constant to the first conductor pattern and the second conductor pattern and thus making a frequency notch effect. Moreover, in the filter circuit, a capacitor for capacitance adjustment is connected to the first capacitor and the second capacitor via switching means.

In the filter circuit according to this invention, the first to third conductor patterns are electromagnetically coupled and resonate in a predetermined frequency band corresponding to the passing frequency $\lambda$, and a high-frequency signal of a predetermined frequency band selected from high-frequency signals inputted to the first conductor pattern is outputted from the second conductor pattern. In this filter circuit, inductive electromagnetic coupling is made between the first conductor pattern and the second conductor pattern, each of which is formed with the length shorter than $\lambda/4$ of the passing wavelength $\lambda$ and has its distal end short-circuited, and capacitive electromagnetic coupling is made between the first conductor pattern and the second conductor pattern, and the third conductor pattern, which has its distal end opened. In the filter circuit according to this invention, as the internal capacitance formed by each conductor pattern and the parallel capacitance added by the first capacitor and the second capacitor are optimally set, the resonance frequency band prescribed by the lengths of the first conductor pattern and the second conductor pattern is lowered, and predetermined filter characteristics are maintained and miniaturization is realized even when each conductor pattern is formed with a length much shorter than $\lambda/4$.

The other objects of this invention and specific advantages provided by this invention will be further clarified by the following description of embodiments described with reference to the drawings.

BRIEF DESCRIPTION OF THE DRAWINGS

FIG. 2A is a sectional view thereof. FIG. 2B is a plan view showing a dielectric board on which resonator conductor patterns are formed. FIG. 2C is a plan view showing the dielectric board on which a ground pattern is formed.

BEST MODE FOR CARRYING OUT THE INVENTION

Figure 4:
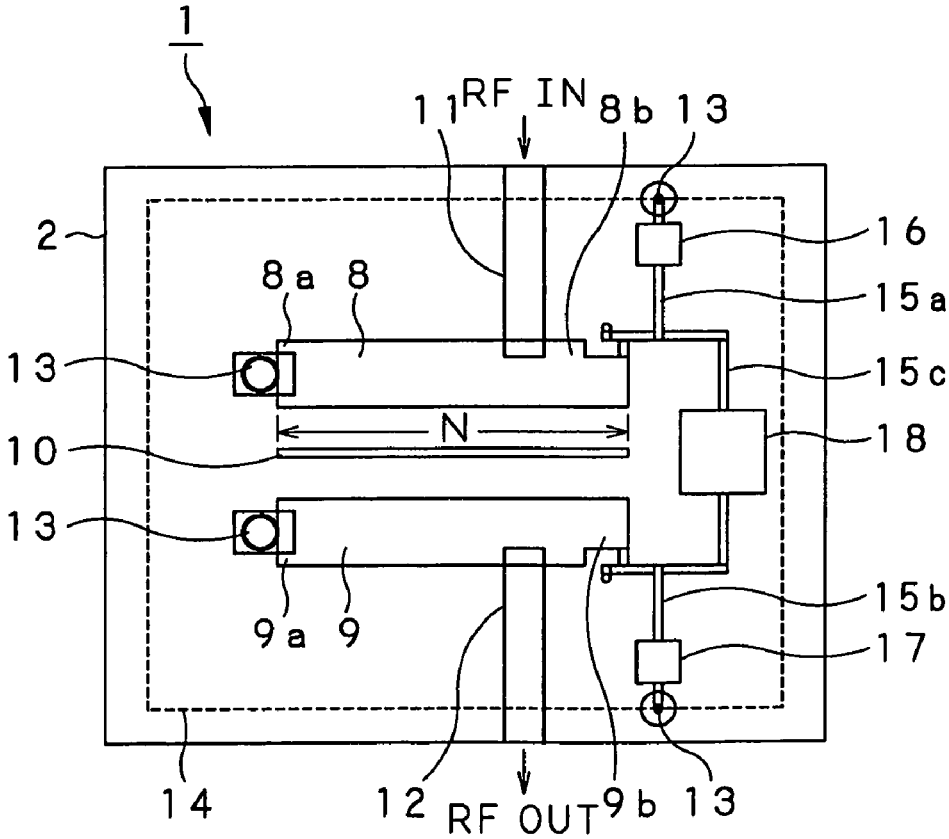
FIG. 4 is a schematic plan view showing the structure of a band-pass filter according to this invention.

Hereinafter, an exemplary application of this invention to a band-pass filter (BPF) based on distributed constant design will be described. A BPF is used, for example, for a band-pass filter circuit forming an antenna input/output unit of a communication function module unit, though not shown. It has a characteristics of passing a transmitted/received signal superimposed on a 2.4-GHz carrier frequency, for example, in accordance with the radio LAN system, Bluetooth or the like, transmitted and received by an antenna. A BPF 1 has a triplate structure having first to third conductor patterns 8 to 10, an input conductor pattern 11 and an output conductor pattern 12, which will be described later in detail, patterned within a dielectric board 2, as shown in FIG. 4.

Figure 7:
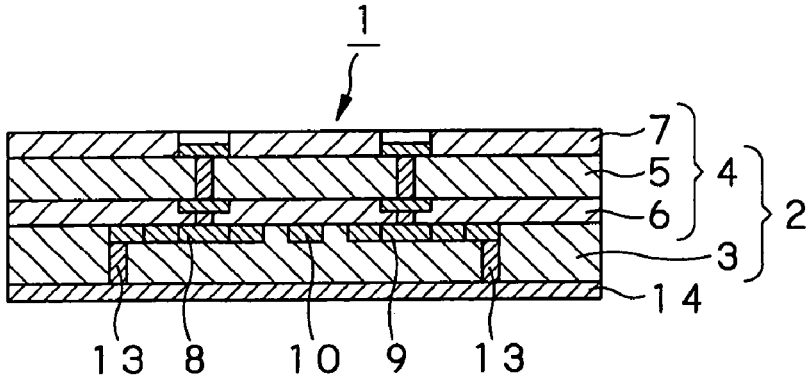
FIG. 7 is a schematic longitudinal sectional view in the direction of width showing the structure of each conductor pattern built in a dielectric board of the band-pass filter.

The BPF 1 has the dielectric board 2 including a base board 3 and a resin board stacked on the base board 3, as shown in FIG. 7. As the base board 3, for example, a copper-clad multilayer board of FR grade 4 having a copper foil layer formed on one major surface of a glass epoxy board is used. The resin board 4 is formed by stacking dielectric insulating layers 6, 7 having a predetermined thickness on both sides of a core 5. The first to third conductor patterns 8 to 10, which will be described later in detail, are patterned on a major surface of the dielectric insulating layer 6 forming the stacking surface to the base board 3, and a ground pattern is formed on a major surface of the dielectric insulating layer 7. The dielectric board 2 thus has the above-described triplate structure.

In the dielectric board 2, each of the dielectric insulating layers 6, 7 on the resin board 4 is made of a dielectric insulating material having a predetermined thickness and characteristics of low dielectric constant and low Tanδ, that is, excellent high-frequency characteristics. Specifically, the dielectric insulating layers 6, 7 are made of an organic dielectric resin material such as polyphenylethylene (PPE), bismaleidetriazine (BT-resin), polytetrafluoroethylene (Teflon: trademark registered), polyimide, liquid crystal polymer, polynorbornene (PNB) or polyolefin resin, an inorganic dielectric material such as ceramics, or a mixture of an organic dielectric resin material and an inorganic dielectric material. Also for the base board 3, a similar dielectric insulating material may form a base material.

Figure 8:
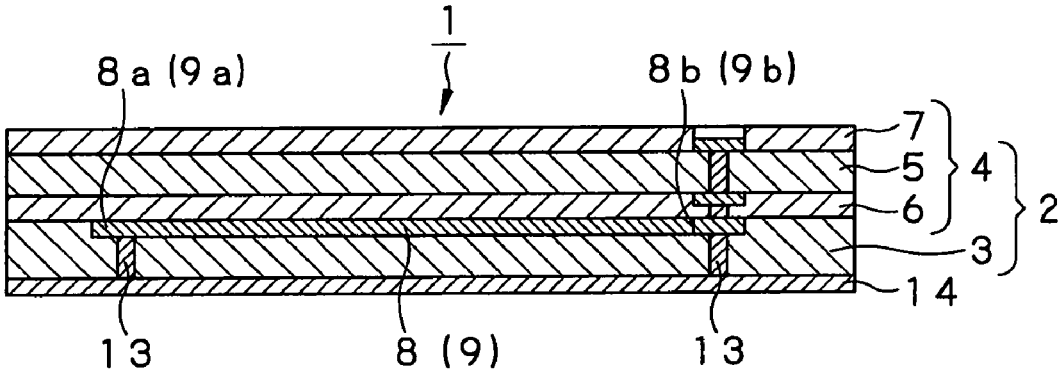
FIG. 8 is a longitudinal sectional view thereof in the direction of length.

In the BPF 1, via-holes 13 are suitably formed in the base board 3 and the resin board 4 of the dielectric board 2, as shown in FIGS. 7 and 8. Through these via-holes 13, wiring patterns 15 formed on an inner layer are connected to a metal layer 14 on the base board 3. The metal layer 14 is formed substantially on the entire major surface of the base board 3 and serves as a ground pattern 14. Interlayer connection is made between the ground pattern 14 and the ground pattern on the side of the dielectric insulating layer 7 through the via-holes 13 in the outer circumferential part of the dielectric board 2.

The BPF 1 has a first capacitor 16 and a second capacitor 17 that are connected in parallel to the first conductor pattern 8 and the second conductor pattern 9 via a first short-circuit pattern 15*a* and a second short-circuit pattern 15*b*, as shown in FIG. 4. The BPF 1 has a third capacitor 18 connected in series to the first conductor pattern 8 and the second conductor pattern 9 via a wiring pattern 15*c*. In the BPF 1, for example, the first capacitor 16 and the second capacitor 17 are formed as film-forming elements in the dielectric insulating layer 6 or the dielectric insulating layer 7, and the third capacitor 18 is mounted as a chip component connected via the via-hole 13 on the major surface of the dielectric insulating layer 7.

The first conductor pattern 8 and the second conductor pattern 9 are formed by relatively wide rectangular patterns and are made parallel to each other to face each other at a predetermined spacing in the longitudinal direction, as shown in FIG. 4. The third conductor pattern 10 is formed by a narrow rectangular pattern, situated between the first conductor pattern 8 and the second conductor pattern 9, and made parallel to these conductor patterns over the entire length. These first to third conductor patterns 8 to 10, the input conductor pattern 11 and the output conductor pattern 12 are patterned by a conventionally used technique including, for example, a metal foil attaching process, a patterning process by photolithography, or an etching process.

The input conductor pattern 11 is protruding in an arm-like shape from the first conductor pattern 8, thus forming a conductor pattern on the primary side where a high-frequency signal is inputted. As shown in FIG. 4, one end side of the first conductor pattern 8 is a short-circuit end 8*a* connected to the ground pattern 14 through the via-hole 13, and the other end side is an open end 8*b*. Similarly, the output conductor pattern 12 is protruding in an arm-like shape from the second conductor pattern 9, thus forming a conductor pattern on the secondary side where a high-frequency signal of a predetermined frequency band selected from inputted high-frequency signals is outputted, as will be described later in detail. Again, one end side of the second conductor pattern 9 is a short-circuit end 9*a* connected to the ground pattern 14 through the via-hole 13, and the other end side is an open end 9*b*.

The first conductor pattern 8 and the second conductor pattern 9 have the same length. This length N is $N<<\lambda/4$, which is means that N is much shorter than the electric length $\lambda/4$ of approximately 6 mm with respect to the passing wavelength $\lambda$ of the carrier frequency band. The first conductor pattern 8 and the second conductor pattern 9 are formed with a length of approximately 2.7 mm, while the electric length $\lambda/4$ with respect to the passing wavelength $\lambda$ of the 2.4-GHz carrier frequency band is approximately 6 mm. Also the third conductor pattern 10 has a length of approximately 2.7 mm, which is the same length as the length of the first conductor pattern 8 and the second conductor pattern 9.

Figure 5:
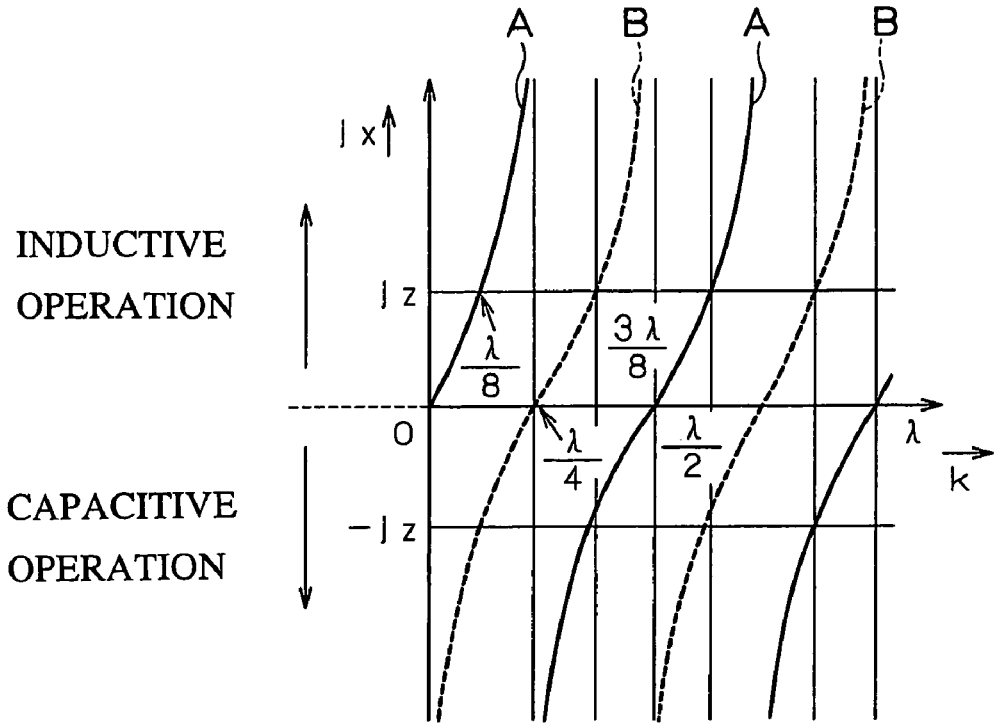
FIG. 5 is a graph showing the length of line and the passing frequency related to an electromagnetic coupling operation of a pair of line patterns in a transmission circuit.

Meanwhile, in transmission lines, a distal end short-circuit type line and a distal end open type line of a pair of electromagnetically coupled lines show difference operation characteristics, that is, inductive operation characteristic and capacitive operation characteristic, in accordance with a line length k with respect to the passing wavelength $\lambda$, as shown in FIG. 5. Specifically, the distal end short-circuit type line shows an inductive operation characteristic (inductor) within a range of $0<k<\lambda/4$, as indicated by a solid line A in FIG. 5. On the other hand, the distal end open type line shows a capacitive operation characteristic (capacitor) within a range of $0<k<\lambda/4$, as indicated by a dotted line in FIG. 5.

The BPF 1 according to this invention has the basic structure in which the first to third conductor patterns 8 to 10 formed in the dielectric board 2 utilize the resonance characteristics prescribed by their respective lengths, as in the above-described conventional BPF 110. However, the BPF 1 has the structure including inductive elements and a capacitive element. Specifically, in the BPF 1, the first conductor pattern 8 and the second conductor pattern 9, which have the above-described length and have their respective one ends short-circuited, are electromagnetically coupled to form an inductor LI and an inductor LO, respectively. In the BPF 1, the third conductor pattern 10, which has the above-described length and has its both ends opened, form a capacitor C3 with respect to the first conductor pattern 8 and the second conductor pattern 9.

Figure 6:
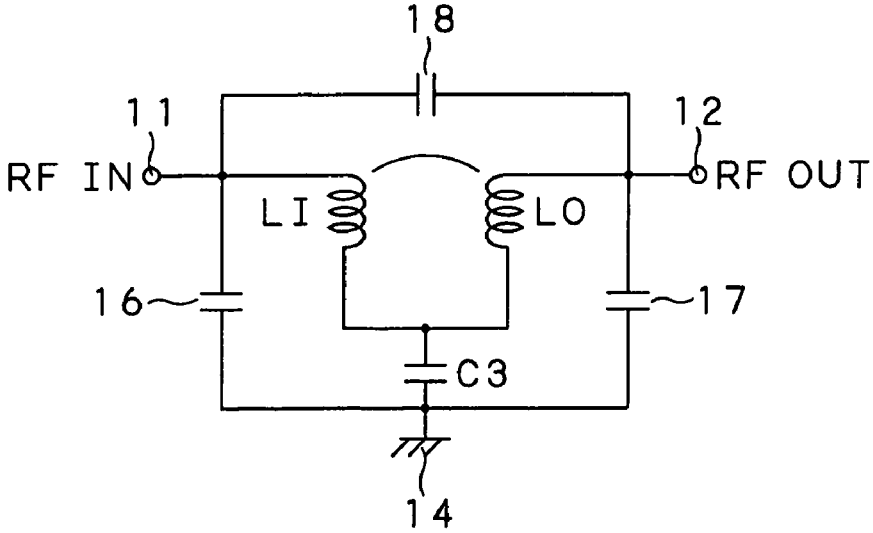
FIG. 6 is a circuit diagram showing a parallel resonance circuit of the band-pass filter.

In the BPF 1, the first to third conductor patterns 8 to 10, the first capacitor 16 and the second capacitor 17 form an equivalent circuit as shown in FIG. 6. Specifically, in the BPF 1, the primary side inductor LI formed by the first conductor pattern 8 and the ground pattern 14, and the secondary side inductor LO formed by the second conductor pattern 9 and the ground pattern 14 are electromagnetically coupled. In the BPF 1, these primary side inductor LI and secondary side inductor LO are capacitive-coupled via the capacitor C3 formed by the third conductor pattern 10 and the ground pattern 14.

Moreover, in the BPF 1, parallel capacitance is added to the primary side inductor LI by the first capacitor 16, and parallel capacitance is added to the secondary side inductor LO by the second capacitor 17. In the BPF 1, the third capacitor 18 is connected in series between the first capacitor 16 and the second capacitor 17, thus adding serial capacitance to the primary side inductor LI and the secondary side inductor LO.

In the BPF 1 according to this invention, since the first conductor pattern 8 and the second conductor pattern 9 are formed with a length much shorter than $\lambda/4$ with respect to the wavelength $\lambda$ of the inputted high-frequency signal, as described above, resonance is generated in a frequency band higher than the desired passing wavelength $\lambda$ by the electromagnetically coupled primary side inductor LI and secondary side inductor LO. Meanwhile, in the BPF 1, since parallel capacitance is added to the primary side inductor LI and the secondary side inductor LO by the first capacitor 16 and the second capacitor 17, the resonance frequency band raised by the shortening of the pattern length is lowered and the degree of coupling is maximized similarly to the line length of $\lambda/4$. Therefore, with the BPF 1, a high-frequency signal having the wavelength $\lambda$ inputted from the side of the first conductor pattern 8 resonates in the band of the predetermined passing wavelength $\lambda$ so that the high-frequency components out of the band are removed, and the resulting signal is outputted from the side of the second conductor pattern 9.

In the BPF 1, the frequency notch effect on the inputted high-frequency signal is performed by the third capacitor 18 inserted in series between the first capacitor 16 and the second capacitor 17. Therefore, with the BPF 1, trap and attenuation pole components are reduced and a high-frequency signal from which unwanted components have been removed is outputted from the second conductor pattern 9 in a stable condition.

Figure 9:
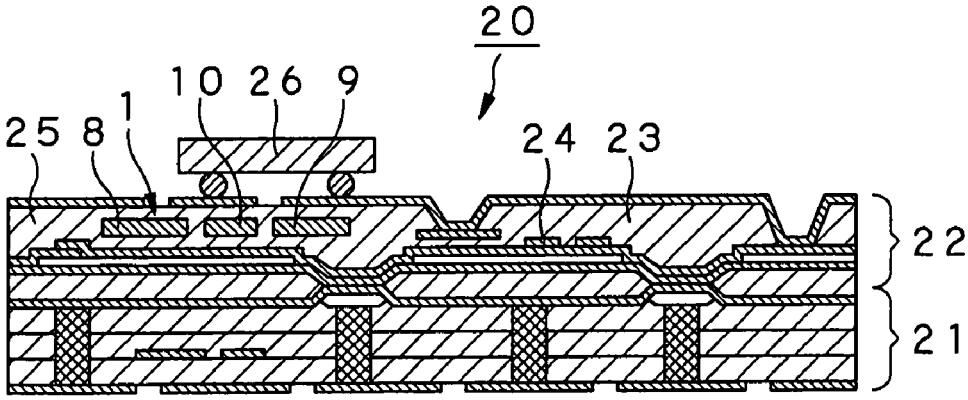
FIG. 9 is a schematic longitudinal sectional view of a communication module board equipped with the band-pass filter.

The BPF 1 constructed as described above may include a communication module board 20, for example, as shown in FIG. 9. The communication module board 20 includes a base board part 21 made of an organic board having multiple wiring layers formed thereon and having the uppermost layer flattened, and a high-frequency circuit part 22 stacked on the base board part 21. In the communication module board 20, though not described in detail, a power circuit and a control circuit are formed in the base board part 21, and the BPF 1 and a high-frequency signal circuit or processing circuit are formed in the high-frequency circuit part 22.

In the communication module board 20, a sufficiently large area for forming the power circuit and ground can be provided on the base board part 21, and power supply with high regulation is carried out. In the communication module board 20, since electrical isolation from the high-frequency circuit part 22 is made and occurrence of interference are restrained, its properties are improved.

In the communication module board 20, a relatively inexpensive organic board is used as the base, and an insulating dielectric layer 23 made of the above-described insulating dielectric material is stacked on the flattened uppermost layer, thus forming the high-frequency circuit part 22. In the communication module board 20, a suitable wiring pattern 24 and a passive element 25 such as an inductor element, capacitor element or resistor element are formed by a thin film forming technique in the insulating dielectric layer 23. In the communication module board 20, a chip component 26 is mounted on the high-frequency circuit part 22, as shown in FIG. 9.

In the BPF manufacturing process, generally, since predetermined filter characteristics cannot be acquired in some cases because of the difference during the manufacturing process, processing to adjust the position and shape of each part is performed while checking the output characteristics by a measuring device or the like. However, in the BPF 1, it is difficult to perform such adjustment processing since the first to third conductor patterns 8 to 10, the first capacitor 16 and the second capacitor 17 are formed within the dielectric board 2, as described above.

Figure 10:
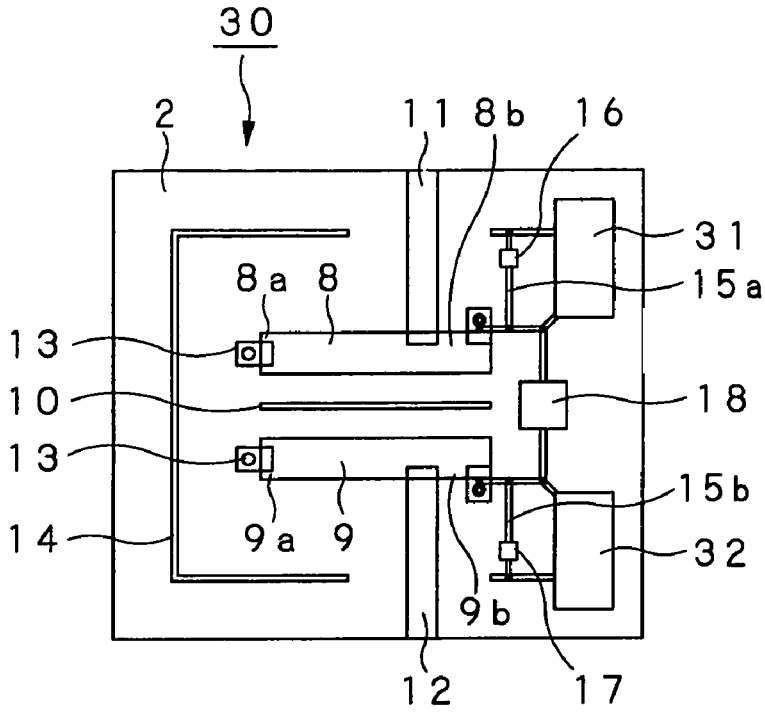
FIG. 10 a schematic plan view of another band-pass filter having a structure for adjusting parallel capacitance to be added to a first conductor pattern and a second conductor pattern.

In a BPF 30 shown in FIG. 10, a first capacitor 31 and a second capacitor 32 for capacitance adjustment are connected in parallel to the first capacitor 16 and the second capacitor 17 for adding parallel capacitance to the first conductor pattern 8 and the second conductor pattern 9, respectively. The first capacitor 31 and the second capacitor 32 are mounted on the surface of the dielectric board 2, for example, as chip components, and are connected to the first capacitor 16 and the second capacitor 17 via the via-holes 13.

The BPF 30 is adjusted to achieve desired output characteristics by suitably replacing the first capacitor 31 and the second capacitor 32, which are made of mounting-type chip components. Of course, in the BPF 30, it is possible to use capacitors made of chip components instead of the above-described built-in type first capacitor 16 and second capacitor 17. However, chip capacitors have such a characteristic that as the capacitance value increase, the self-resonance frequency is lowered and the capacitance value jumps more roughly. In the BPF 30, as the built-in type first capacitor 16 and second capacitor 17, and the chip-type first capacitor 31 and second capacitor 32 having a small capacitance value, are connected in parallel, fine tuning of a high-frequency signal is accurately carried out.

Figure 1:
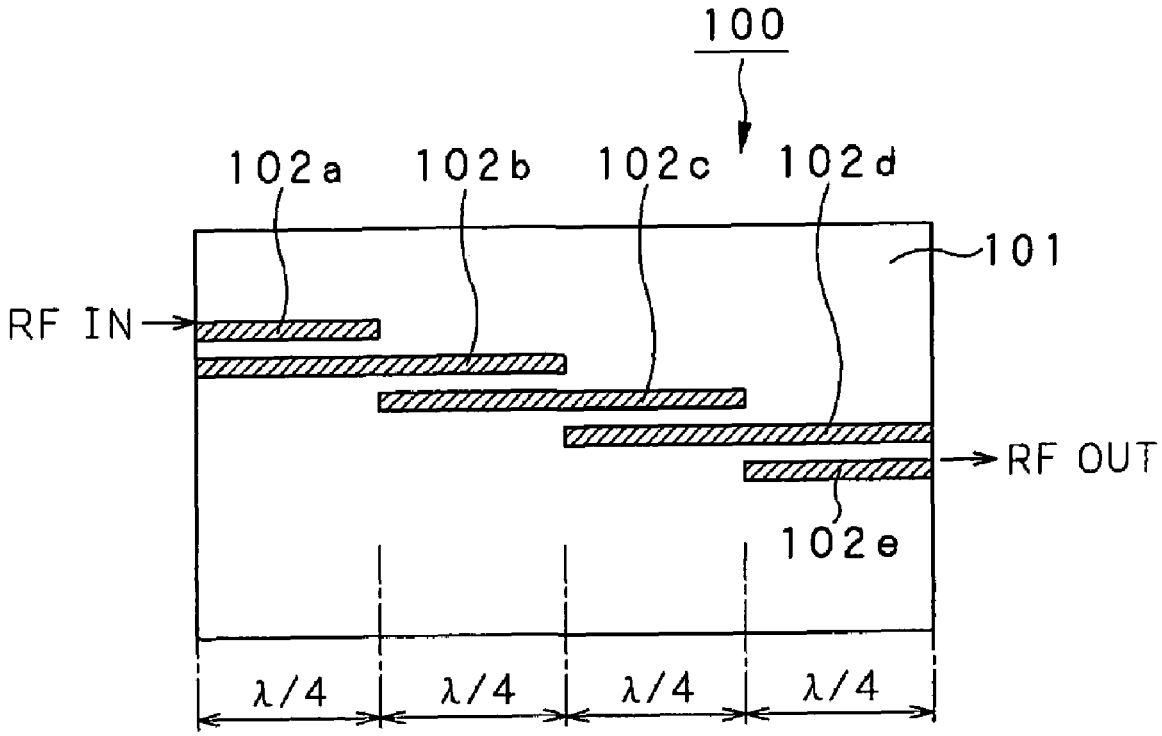
FIG. 1 is a schematic plan view showing a conventional band-pass filter.
Figure 2A:
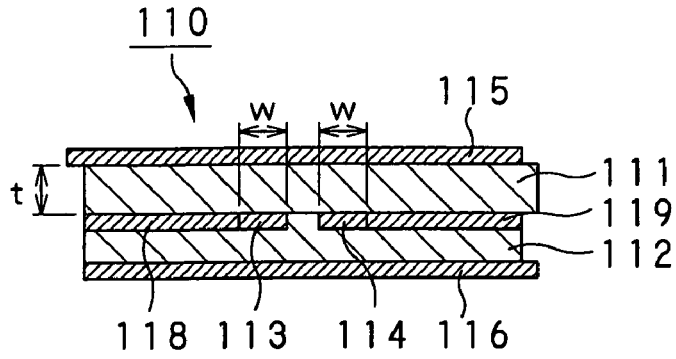
FIGS. 2A to 2C show a conventional band-pass filter of a triplate structure.
Figure 2B:
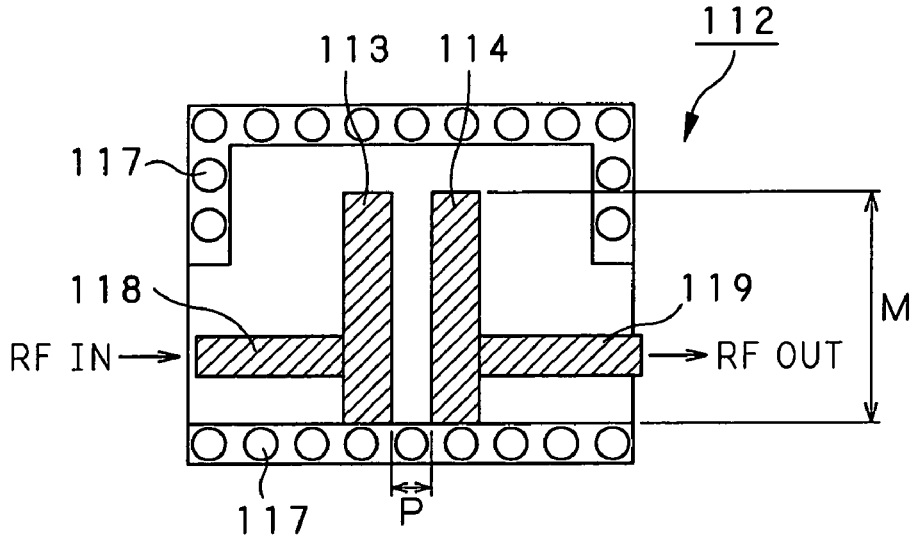
Figure 2C:
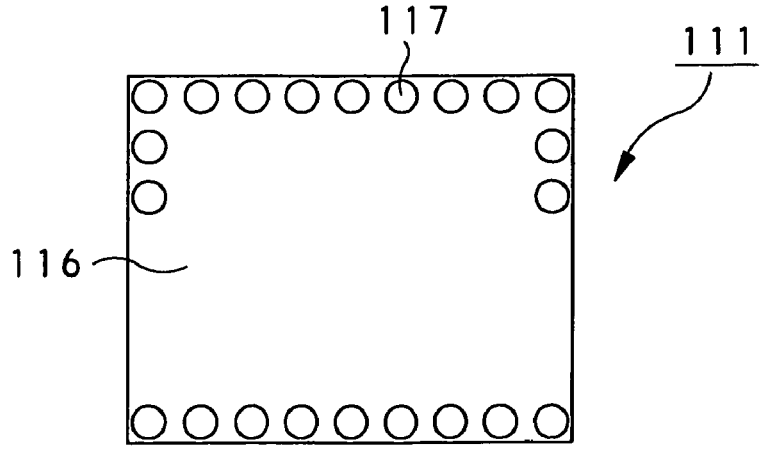
Figure 3:
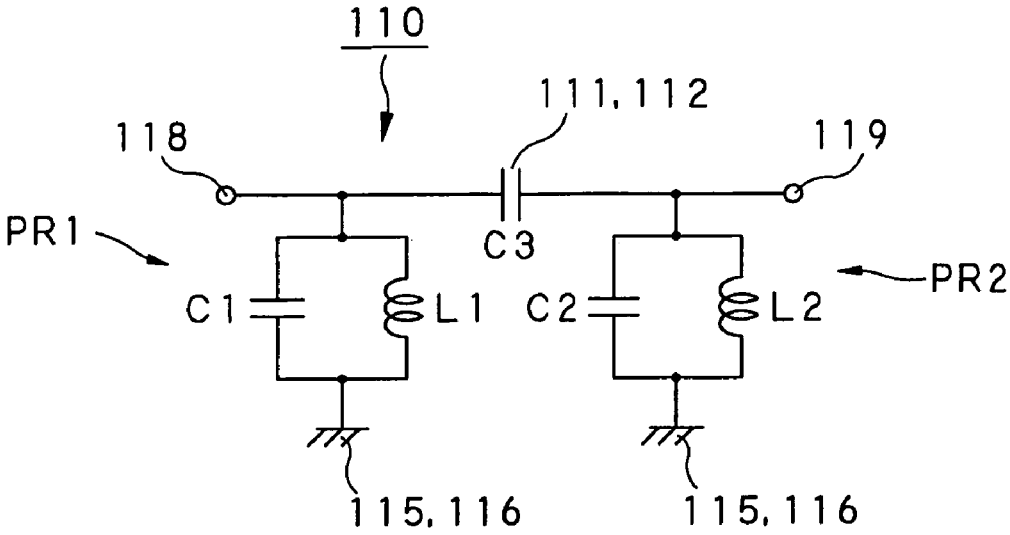
FIG. 3 is a circuit diagram showing parallel resonance circuits of the conventional band-pass filter of the triplate structure.

A later adjustment process can be carried out also in a BPF 35 shown in FIG. 1. The BPF 35 has plural first capacitance adding circuits formed by series circuits including first MEMS switches 36*a* to 36*n* and first capacitors 37*a* to 37*n* and connected to the first conductor pattern 8 via an array pattern 15*d*, and plural second capacitance adding circuits formed by series circuits including second MEMS switches 38*a* to 38*n* and second capacitors 39*a* to 39*n* and connected to the second conductor pattern 9 via an array pattern 15*e*.

Figure 11:
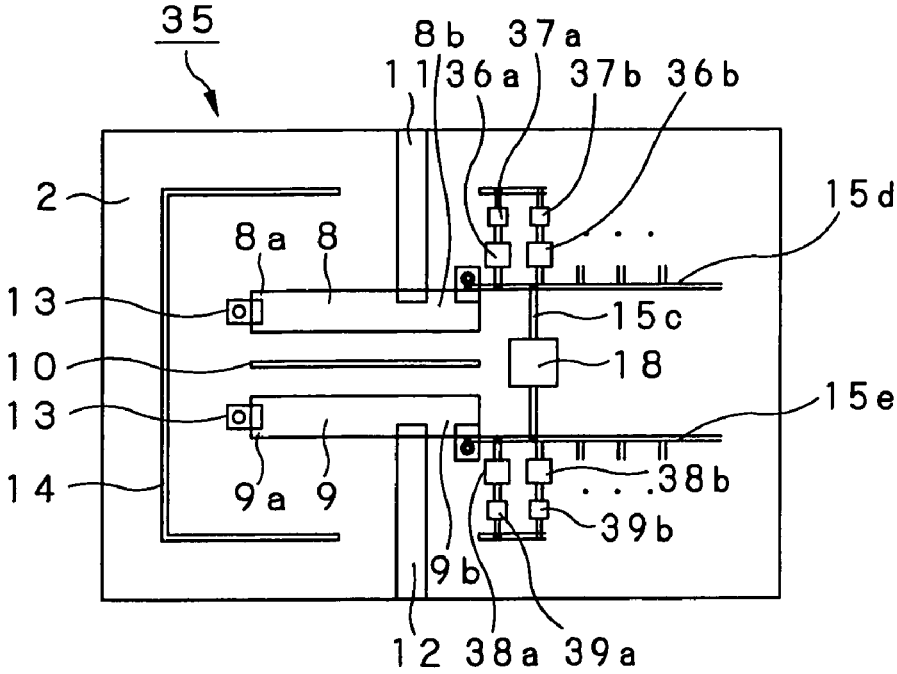
FIG. 11 is a schematic plan view of another band-pass filter having parallel capacitance adjustment structure using MEMS switches.

In the BPF 35 shown in FIG. 11, as the first MEMS switches 36*a* to 36*n* are selectively switched, the connection state between the first conductor pattern 8 and the group of first capacitors 37 is switched to adjust the added capacitance. Similarly, as the second MEMS switches 38*a* to 38*n* are selectively switched, the connection state between the second conductor pattern 9 and the group of second capacitors 39*a* to 39*n* is switched to adjust the added capacitance.

Figure 12A:
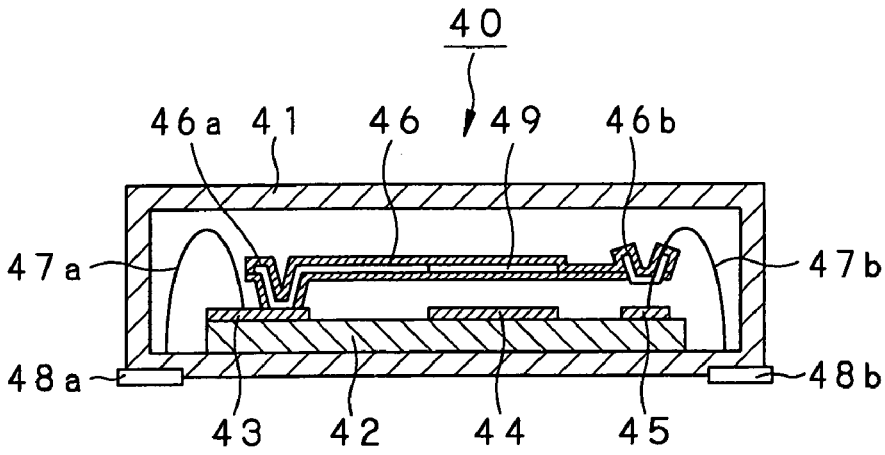
FIG. 12A is a longitudinal sectional view of a MEMS switch in a non-continuity state.
Figure 12B:
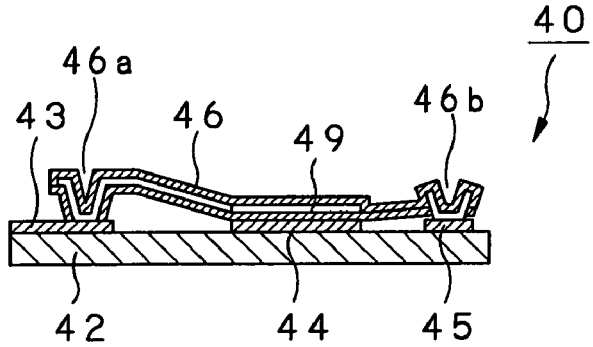
FIG. 12B is a schematic longitudinal sectional view of the MEMS switch in an operating state.

FIGS. 12A and 12B show a typical MEMS (micro electromechanical system) switch 40. The MEMS switch 40 is entirely covered with an insulating cover 41, as shown in FIG. 12A. In the MEMS switch 40, a first fixed contact 43, a second fixed contact 44 and a third fixed contact 45 are formed on a silicon substrate 42 and insulated from each other. In the MEMS switch 40, a flexible moving contact piece 46 of a thin plate shape is rotatably supported at its one side on the first fixed contact 43. In the MEMS switch 40, the first fixed contact 43 and the third fixed contact 45 are used as input/output contacts and connected to input/output terminals 48*a*, 48*b* provided on the insulating cover 41 via leads 47*a*, 47*b*, respectively.

In the MEMS switch 40, one end of the moving contact piece 46 is a constantly closed contact to the first fixed contact 43 on the side of the silicon substrate 42, and its freer end forms a constantly open contact to the third fixed contact 45. An electrode 49 is provided within the moving contact piece 46, corresponding to the second fixed contact 44 formed at the central part. In the MEMS switch 40, in the normal state, one end of the moving contact piece 46 is in contact with the first fixed contact 43 and its other end is held in a non-contact state with the third fixed contact 45, as shown in FIG. 12A.

Each MEMS switch 40 constructed as described above is mounted on the major surface of the dielectric board 2. One input/output terminal 48*a* of each MEMS switch 40 is connected to the array patterns 15*d*, 15*e* and the other input/output terminal 48*b* is connected to the first capacitors 37 or the second capacitors 39. Therefore, the MEMS switch 40 maintains the insulating state of the array patterns 15*d*, 15*e*, that is, between the first conductor pattern 8 and the first capacitors 37 or between the second conductor pattern 9 and the second capacitors 39.

When a driving signal is inputted to the MEMS switch 40, a driving voltage is applied to the second fixed contact 44 and the internal electrode 49 of the moving contact piece 46. In the MEMS switch 40, this generates an attracting force between the second fixed contact and the moving contact piece 46, and the moving contact piece 46 is displaced about the first fixed contact 43 as the fulcrum toward the silicon substrate 42 and has its free end connected to the third fixed contact 45. This connection state is maintained. In the MEMS switch 40, when a driving voltage of backward bias is applied to the second fixed contact 44 and the internal electrode 49 of the moving contact piece 46 in the above-described state, the moving contact piece 46 restores its initial state and the connection state with the third fixed contact 45 is canceled. Since the MEMS switch 40 is a switch that is very small and needs no holding current for holding the operating state, providing the MEMS switch 40 in the BPF 35 does not increase the size of the BPF 35 and also realizes lower power consumption.

Figure 13:
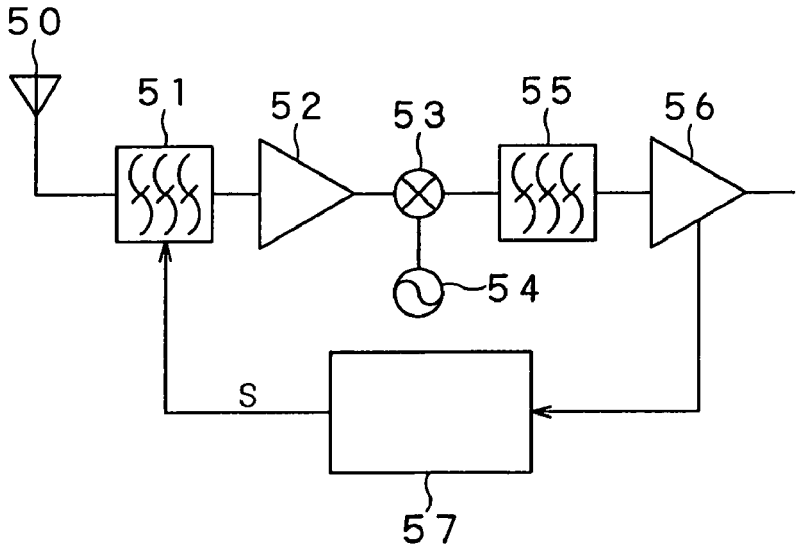
FIG. 13 is a circuit diagram showing a band-pass filter circuit having a band-pass filter equipped with MEMS switch to form feedback logic.

In the BPF 35, as a reference signal is inputted to the input conductor pattern 11 on the side of the first conductor pattern 8 and on/off control of the first MEMS switches 36 and the second MEMS switches 38 is carried out while measuring an output from the output conductor pattern 12 on the side of the second conductor pattern 9, the filter characteristics are adjusted. Therefore, the BPF 35 forms feedback logic of a band-pass filter circuit, for example, as shown in FIG. 13. The band-pass filter circuit is given a characteristic of passing a high-frequency signal superimposed on a 2.4 GHz frequency band, and includes a BPF 51, an amplifier 52, a mixer 53 and an oscillator 54, which process a signal received by an antenna 50. In the band-pass filter circuit, a second BPF 55 passes a high-frequency signal of a predetermined frequency band outputted from mixer 53 and supplies the signal to a receiving amplifier 56.

In the band-pass filter circuit, in consideration of the filter characteristics prescribed by the thickness of the dielectric board 2 and the position, shape and the like of the first to third conductor patterns 8 to 10, when a certain change occurs in the environment of the device in which the band-pass filter circuit is used, for example, when a metallic material or dielectric material is arranged closely to the device or the temperature or humidity changes, the frequency characteristics of the BPF 51 may be deviated and the received power from the antenna 50 may be lowered. In the band-pass filter circuit, the output level of the receiving amplifier 56 is detected, and when a lowering state is detected, the detection output is sent to a switch driving circuit part 57.

In the band-pass filter circuit, a control signal S for driving the first MEMS switches 36 and the second MEMS switches 38 is generated by the switch driving circuit part 57 and is fed back to the BPF 51. In the band-pass filter circuit, as on/off control of the first MEMS switches 36 and the second MEMS switches 38 is selectively carried out, the frequency characteristics are fine-tuned as described above.

The capacitance adjustment structure is not limited to the above-described structure of the BPF 35. For example, instead of the first MEMS switches 36 and the second MEMS switches 38, an open state may be provided between the array patterns 15*d*, 15*e* and the first and second capacitors 37, 39, and conductive paste such as silver paste or a copper foil may be suitably attached later to form a short circuit.

Figure 14:
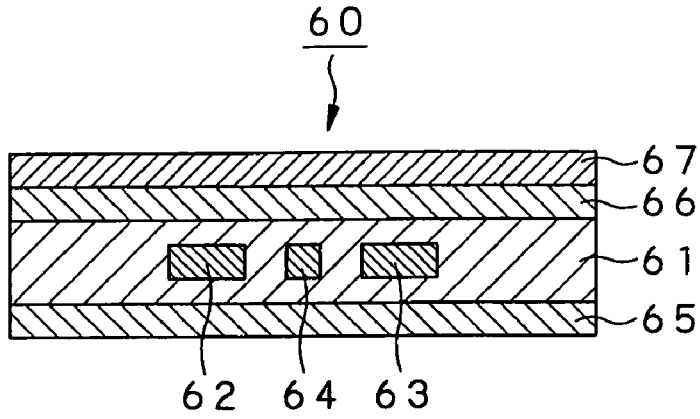
FIG. 14 is a schematic longitudinal sectional view showing the band-pass filter.
Figure 15:
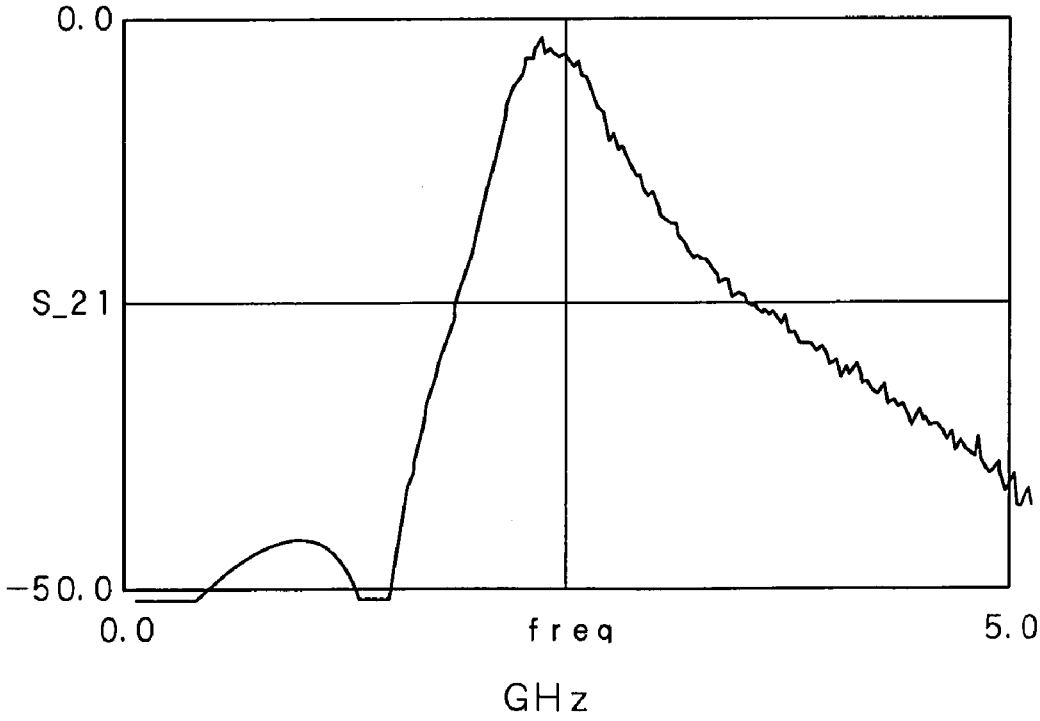
FIG. 15 is a graph showing filter characteristics of the band-pass filter.

With respect to the BPF according to this invention constructed as described above, FIG. 15 shows the result of property simulation based on the specifications of a BPF 60 shown in FIG. 14. In the BPF 60, first to third conductor patterns 62 to 64 of the above-described structure are patterned in a dielectric layer 61, and first to third capacitors are provided, though not shown. The BPF 60 has a triplate structure in which ground patterns 65, 66 are formed on both sides of the dielectric layer 61. In the BPF 60, a thin film layer 67 is stacked on the ground pattern 66.

In the BPF 60, the dielectric layer 61 has a total thickness of approximately 0.7 mm and an average relative dielectric constant of 3.8. In the BPF 60, the first conductor pattern 62 and the second conductor pattern 63 are formed with a length of approximately 2.7 mm, and the first capacitor and the second capacitor for adding parallel capacitance to the first conductor pattern 62 and the second conductor pattern 63 have capacitance of approximately 3 pF each. In the BPF 60, the third capacitor for adding serial capacitance has capacitance of approximately 0.7 pF. Of course, in the BPF 60, the first conductor pattern 62 and the second conductor pattern 63 have their respective one ends short-circuited and the third conductor pattern 64 has its both ends opened.

In the BPF 60, the first conductor pattern 62 and the second conductor pattern 63 are formed with a length much shorter than $\lambda/4$ of the passing wavelength $\lambda$, as described above. However, as can be seen from FIG. 15, the maximum resonance characteristic appears in the 2.4-GHz band without being prescribed by the lengths of the first conductor pattern 62 and the second conductor pattern 63.

Figure 16:
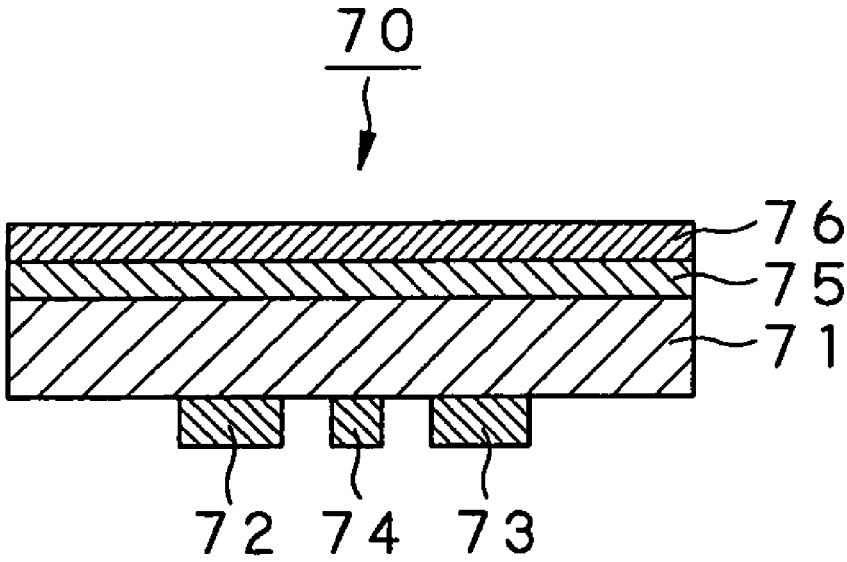
FIG. 16 is a schematic longitudinal sectional view showing a band-pass filter having conductor patterns formed on the surface of a dielectric layer.

While the first to third conductor patterns 8 to 10 are patterned on the inner layer of the dielectric board 2 in the above-described embodiments, this invention is not limited to this structure. In a BPF 70 shown in FIG. 16, first to third conductor patterns 72 to 74 are patterned on a major surface of a dielectric layer 71. In the BPF 70, a ground pattern 75 is formed entirely over the other major surface of the dielectric layer 71, and a thin film layer 76 is formed on the ground pattern 75. In the BPF 70, the first to third conductor patterns 72 to 74 form a microstrip line structure.

Figure 17:
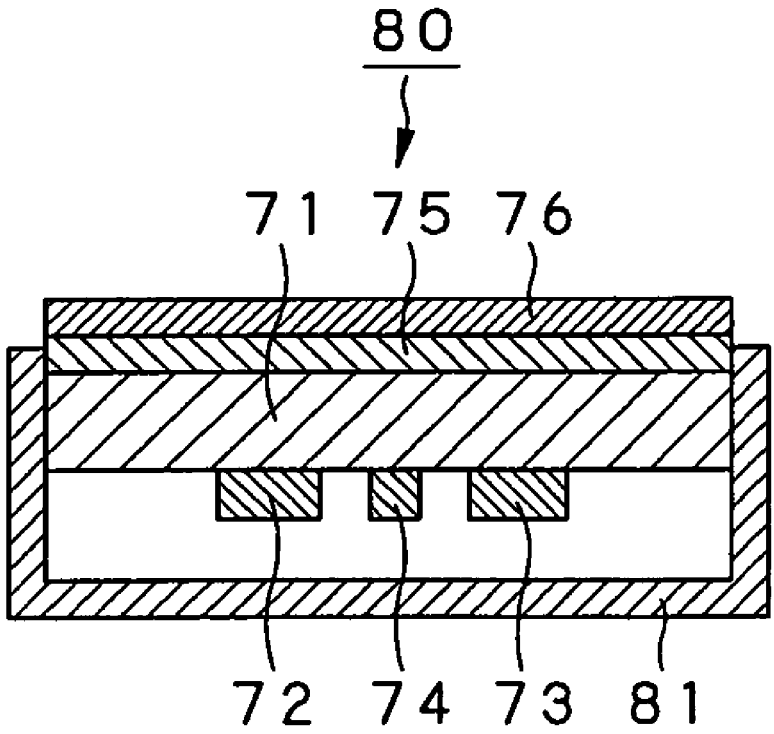
FIG. 17 is a schematic longitudinal sectional view showing a band-pass filter having conductor patterns formed on the surface of a dielectric layer and having a shield cover provided over them.

In a BPF 80 shown in FIG. 17, a shield case 81 is combined with the dielectric layer 71 of the above-described BPF 70. In the BPF 80, the first to third conductor patterns 72 to 74 are enclosed by the dielectric layer 71 and a dielectric layer of air between the ground pattern 75 and the shield case 81, thus forming a strip line structure. In the BPF 80, loss due to parasitic capacitance is reduced by the shield case 81.

It should be understood by those ordinarily skilled in the art that the invention is not limited to the embodiments illustrated in the accompanying drawings and described in the above description in detail, but various modifications, alternative constructions or equivalents can be implemented without departing from the scope and spirit of the present invention as set forth and defined by the appended claims.

INDUSTRIAL APPLICABILITY

The filter circuit according to this invention has first to third conductor patterns that are formed as distributed line patterns parallel to each other on a dielectric board and electromagnetically coupled with each other. A first capacitor and a second capacitor add parallel capacitance to the first conductor pattern and the second conductor pattern, which have their distal ends short-circuited for inductive coupling, and these conductor patterns are capacitive-coupled with the third conductor pattern, which is formed by an open pattern, thus forming an internal capacitor. Therefore, while the first to third conductor patterns are formed with a length much shorter than $\lambda/4$ of the passing wavelength, the resonance frequency band can be lowered by the combination of internal capacitance and parallel capacitance to be added, irrespective of the line length of each conductor pattern. Thus, miniaturization is realized and desired frequency characteristics can be acquired.

Moreover, in the filter circuit according to this invention, as the capacitance of the first capacitor and the second capacitor is adjusted, an optimum filter characteristic value can be set even when the filter characteristics are varied or deviated because of some difference during the manufacturing process or changes in the environment. This improves the productivity and yield of the filter circuit and also improves the reliability and performance.

What is claimed is:

1. A filter circuit characterized by comprising:

a dielectric board;

a first conductor pattern formed as a distributed line pattern in the dielectric board and having one end grounded and the other end opened, the first conductor pattern having high-frequency signals inputted thereto;

a second conductor pattern formed as a distributed line pattern parallel to the first conductor pattern in the dielectric board and having one end grounded and the other end opened, the second conductor pattern being electromagnetically coupled with the first conductor pattern and thus outputting a high-frequency signal of a predetermined frequency band selected from the high-frequency signals inputted to the first conductor pattern;

a third conductor pattern formed as a distributed line pattern parallel to the first conductor pattern and the second conductor pattern in the dielectric board and having both ends opened; and a first capacitor and a second capacitor for adding parallel capacitance based on a concentrated constant to the first conductor pattern and the second conductor pattern;

wherein as each of the first to third conductor patterns is formed with a length shorter than $\lambda/4$ with respect to a passing wavelength $\lambda$, inductive electromagnetic coupling is carried out between the first conductor pattern and the second conductor pattern, and capacitive electromagnetic coupling is carried out between the first and second conductor patterns and the third conductor pattern.

2. The filter circuit as claimed in claim 1, characterized by comprising a third capacitor for adding serial capacitance based on a lumped constant to the first conductor pattern and the second conductor pattern.

3. The filter circuit as claimed in claim 2, characterized in that the first to third capacitors are capacitor elements formed as thin films in the dielectric board, capacitor chip elements mounted on the dielectric board, or a combination of capacitor elements formed as thin films in the dielectric board and capacitor chip elements mounted on the dielectric board.

4. The filter circuit as claimed in claim 1, characterized in that a capacitor for capacitance adjustment is connected to the first capacitor and the second capacitor via switching means.

5. The filter circuit as claimed in claim 1, characterized in that, on an inner layer of the dielectric board, the first to third conductor patterns are formed and the first capacitor and the second capacitor are formed as thin films, plural capacitance adjusting circuits, each including switching means and a capacitance adjustment capacitor and connected parallel to the first capacitor or the second capacitor through a via-hole, are provided on an outer layer of the dielectric board, and each of the switching means is switched to adjust parallel capacitance to be added to the first capacitor or the second capacitor by each of the capacitance adjustment capacitors.

6. The filter circuit as claimed in claim 1, characterized in that the first to third capacitors are formed on a first outer layer of the dielectric board, and a metal plate for covering and shielding the first outer layer is provided on the dielectric board and a ground pattern is formed on a second outer layer, so that the first to third conductor patterns form a strip line structure.

7. The filter circuit as claimed in claim 1, characterized in that the dielectric board is formed by a buildup layer including a dielectric insulating layer and a wiring pattern stacked on a buildup forming surface of a base board part in which multiple wiring layers are formed on a base board made of an organic board and an uppermost layer is flattened to form the buildup forming surface, and in the buildup layer, the first to third conductor patterns are patterned and the first capacitor and the second capacitor are formed as thin films.

* * * * *